US006360721B1

(12) United States Patent
Schuricht et al.

(10) Patent No.: US 6,360,721 B1
(45) Date of Patent: Mar. 26, 2002

(54) FUEL INJECTOR WITH INDEPENDENT CONTROL OF CHECK VALVE AND FUEL PRESSURIZATION

(75) Inventors: Scott R. Schuricht, Normal; Manas R. Satapathy, Aurora; Thomas G. Ausman, Metamora; Eric M. Bram, Peoria, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/575,914

(22) Filed: May 23, 2000

(51) Int. Cl.[7] ..... F02M 37/04
(52) U.S. Cl. ..... 123/446; 123/496; 123/467
(58) Field of Search ..... 123/446, 447, 123/472, 496, 467; 239/585.5, 585.1, 585.2

(56) References Cited

U.S. PATENT DOCUMENTS

| | | | | |
|---|---|---|---|---|
| 2,603,192 A | | 7/1952 | Kensok | |
| 2,702,049 A | | 2/1955 | Seeloff | |
| 3,613,508 A | | 10/1971 | Krehbiel | |
| 3,640,466 A | | 2/1972 | Steiger | |
| 3,955,597 A | | 5/1976 | Oneyama et al. | |
| 3,990,549 A | | 11/1976 | Sisson et al. | |
| 4,323,087 A | | 4/1982 | Brunner | |
| 4,326,672 A | | 4/1982 | Goloff | |
| 4,437,388 A | | 3/1984 | Budzich | |
| 4,840,111 A | | 6/1989 | Garnjost | |
| 4,962,887 A | | 10/1990 | Matsuoka | |
| 4,974,495 A | | 12/1990 | Richeson, Jr. | |
| 4,979,542 A | | 12/1990 | Mesenich | |
| 5,337,786 A | | 8/1994 | Rush et al. | |
| 5,397,055 A | | 3/1995 | Paul et al. | |
| 5,669,355 A | * | 9/1997 | Gibson et al. | 123/467 |
| 5,687,693 A | | 11/1997 | Chen et al. | |
| 5,697,342 A | * | 12/1997 | Anderson | 123/446 |
| 5,738,075 A | | 4/1998 | Chen et al. | |
| 5,893,350 A | | 4/1999 | Timms | |
| 6,050,496 A | | 4/2000 | Hefler | |
| 6,050,497 A | | 4/2000 | Cotton | |
| 6,065,450 A | * | 5/2000 | Chen et al. | 123/496 |
| 6,082,332 A | * | 7/2000 | Helfer et al. | 123/446 |

* cited by examiner

*Primary Examiner*—Thomas N. Moulis
(74) *Attorney, Agent, or Firm*—Eric M. Bram

(57) ABSTRACT

A hydraulically actuated fuel injector has an electronically controlled actuator that moves an actuation valve member. The actuator can position the actuation valve member at one position to cause pressurization of fuel in a nozzle chamber for fuel injection, and at another position to hydraulically bias a check to halt fuel injection while maintaining full fuel pressure in the nozzle chamber indefinitely.

13 Claims, 10 Drawing Sheets

FUEL INJECTOR WITH INDEPENDENT CONTROL OF CHECK VALVE AND FUEL PRESSURIZATION

RELATION TO OTHER PATENT APPLICATIONS

This application claims priority of copending application Ser. No. 09/372/550 entitled ROTARY VALVE FOR THREE-WAY CONTROL OF CONTROL LINES IN A HYDRAULICALLY ACTUATED FUEL INJECTOR, and copending application Ser. No. 09/372,689 entitled FUEL INJECTOR WITH INDEPENDENT CONTROL OF CHECK VALVE AND FUEL PRESSURIZATION, both filed on Aug. 11, 1999.

TECHNICAL FIELD

This invention relates generally to fuel injectors having check valves, and more particularly to fuel injectors having a direct hydraulic control of check valves.

BACKGROUND ART

Known hydraulically-actuated fuel injection systems and/or components are shown, for example, in U.S. Pat. Nos. 5,687,693 and 5,738,075 issued to Chen and Hafner et al. on Nov. 18, 1997 and Apr. 14, 1998, respectfully.

In these hydraulically actuated fuel injectors, a spring biased needle check opens to commence fuel injection when pressure is raised by an intensifier piston/plunger assembly to a valve opening pressure. The intensifier piston is acted upon by a relatively high-pressure hydraulic fluid, such as engine lubricating oil, when an actuator driven fluid control valve, for example a solenoid driven fluid control valve, admits high-pressure hydraulic fluid to act on the intensifier piston.

Injection is ended by operating the actuator to release pressure above the intensifier piston. This in turn causes a drop in fuel pressure causing the needle check to close under the action of its return spring and end injection.

Recently, Caterpillar Inc. has developed a new generation of fuel injectors, such as the HEUI-"B"™ fuel system fuel injector, that feature direct control of the spring biased needle check valve. In these fuel injectors, even when fuel pressure has been raised by the intensifier piston to the valve opening pressure, the check valve can be kept shut (or quickly shut if it is open) by applying high-pressure hydraulic fluid directly to a check control chamber to create closing bias on the needle check valve.

A critical component of both types of hydraulically actuated fuel injector is the actuation fluid control valve, which admits the high-pressure hydraulic fluid to the injector. In hydraulically actuated fuel injectors with direct check control the actuation fluid control valve is especially critical because it must be able to control both the intensifier piston and the check valve.

For example, in a HEUI-B™ fuel injector described in co-pending U.S. patent application No. 09/358,990 filed Jul. 22, 1999, claiming priority from U.S. provisional application No. 60/110,897 filed Dec. 4, 1998, and entitled "Hydraulically Actuated Fuel Injector with Seated Pin Actuator" a two-way valve is used both to apply direct control on the check valve, and also to operate a spool valve that controls actuation of an intensifier piston.

With that valve, when high-pressure hydraulic fluid is directed to apply closing bias on the check valve, the spool valve begins to move to drain pressure on the intensifier piston. Although the check valve closes immediately, full pressure is maintained on the intensifier piston for a while after the check valve is closed because of hysteresis in the spool valve. However, eventually hydraulic fluid pressing down on the intensifier piston begins to drain, reducing fuel pressure in the nozzle chamber.

When time separation between two fuel injection events or "shots" is small, the spool valve hysteresis maintains pressure on the intensifier piston until the second shot is completed, so the second shot has good injection characteristics. But as shot separation increases, the time available for the spool to return and drain the pressure on the intensifier piston increases. Once the spool returns fuel pressure begins to decrease, and injection characteristics of the second shot become a function of the separation time.

For at least this reason, it would be advantageous in some applications to keep fuel pressure in the nozzle chamber high for a longer time. Unfortunately, current fuel injectors described above keep the fuel pressure high for only a fixed length of time after direct check control closure. It would be better if fuel pressure in the nozzle chamber could be kept high indefinitely, for a controllable length of time.

Ideally, a control valve would be capable of supplying hydraulic fluid to the intensifier piston and to the check control chamber independently, or otherwise achieve independent control of separate closing and opening biases on the check valve. No feasible method of accomplishing this has hitherto been found.

The present invention is directed to addressing one or more of the topics discussed above.

DISCLOSURE OF THE INVENTION

In a first aspect of the invention, a hydraulically actuated fuel injector comprises a nozzle, a check, a check control chamber, and an actuation valve member. The nozzle has a nozzle orifice and a nozzle chamber.

The check is movable between an open position that allows fluid communication between the nozzle chamber and the nozzle orifice, and a closed position that stops fluid communication between the nozzle chamber and the nozzle orifice. The check control chamber is disposed such that fluid pressure in the check control chamber will exert a closing bias on the check.

The actuation valve member is fluidly connected with a high-pressure supply line, a low-pressure drain line, a check control line fluidly connected with the check control chamber, and a pressure control line. The actuation valve member is positionable at first, second, and third positions.

The first position of the actuation valve member fluidly connects the pressure control line to a first line of the high-pressure supply line and the low-pressure drain line.

The second position of the actuation valve member is different from the first position, fluidly connects the check control line to the high-pressure supply line, and fluidly connects the pressure control line to a second line of the high-pressure supply line and the low-pressure drain line. The second line is different from the first line.

The third position of the actuation valve member is different from the first and second positions, fluidly connects the check control line with the low-pressure drain line, and fluidly connects the pressure control line to the second line.

In a second aspect of the invention, a method is disclosed for controlling a hydraulically actuated fuel injector having a check, an intensifier piston, a nozzle chamber, and an electronically controlled actuator attached with an actuation valve member positionable at at least first, second, and third positions.

The method comprises positioning the actuation valve member at the first position to drain high-pressure hydraulic fluid biasing the intensifier piston, thereby reducing fuel pressure in the nozzle chamber and allowing more fuel to enter the fuel injector; positioning the actuation valve member at the second position to cause high-pressure hydraulic fluid to increase hydraulic bias against the intensifier piston, thereby pressurizing fuel in the nozzle chamber to a first pressure and causing the pressurized fuel to be injected from the nozzle chamber at the first pressure; and positioning the actuation valve member at the third position to cause high-pressure hydraulic fluid to create a closing bias on the check to halt fuel injection while keeping fuel in the nozzle chamber pressurized to at least the first pressure until the actuation valve member is positioned at the second position.

In a third aspect of the invention, a method is disclosed for operating a fuel injector. The method comprises starting fuel injection by producing positive opening hydraulic bias on a check; stopping fuel injection by producing positive closing hydraulic bias on the check; and achieving independent control of production of both the positive opening hydraulic bias and the positive closing hydraulic bias by electronically controlled movement of a single actuation valve member.

In a fourth aspect of the invention, a method is disclosed for controlling a hydraulically actuated fuel injector comprising a check, a nozzle chamber, and an electronically controlled actuator attached with an actuation valve member. The method comprises positioning the actuation valve member at a first position to cause pressurization of fuel in the nozzle chamber to an injection pressure and injection of the fuel from the nozzle chamber at the injection pressure, and positioning the actuation valve member at a second position, different from the first position, to hydraulically bias the check to halt fuel injection from the nozzle chamber while keeping the fuel pressure in the nozzle chamber at the injection pressure indefinitely.

In a fifth aspect of the invention, a hydraulically actuated fuel injector comprises to pressurization means for pressurizing fuel in the fuel injector, check bias means for directly operating a check to stop fuel injection by applying hydraulic bias to the check, and control means for independent control of the pressurization means and the check bias means.

BRIEF DESCRIPTION OF THE DRAWINGS

Features of the invention can be better understood with reference to the drawing figures, in which certain features may be repositioned to better explain their functions and certain dimensions may be exaggerated, to illustrate check position functions for example, and in which.

BEST MODES FOR CARRYING OUT THE INVENTION

The invention is now described with reference to FIGS. 1–19, which illustrate several embodiments of fuel injectors according to the invention.

Figure 1:
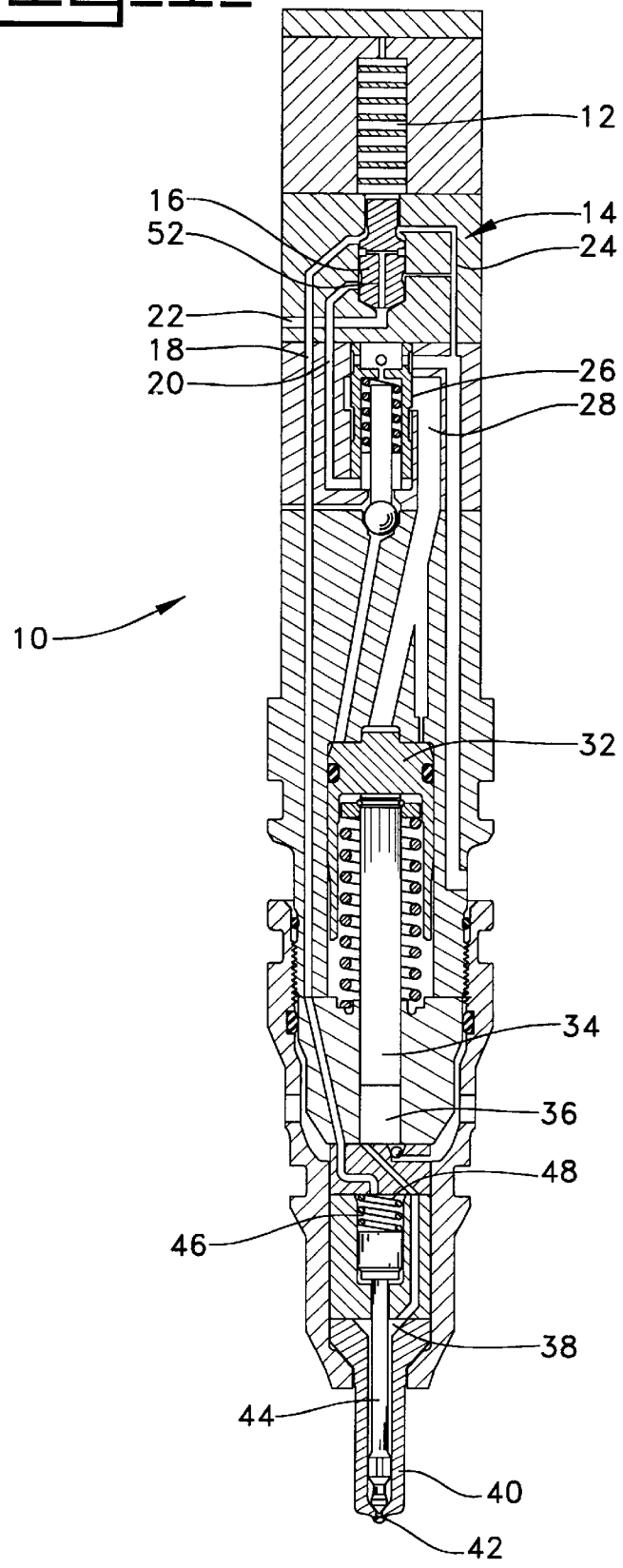
FIG. 1 is a diagrammatic side view representation of a fuel injector according to a first embodiment of the invention.
Figure 2:
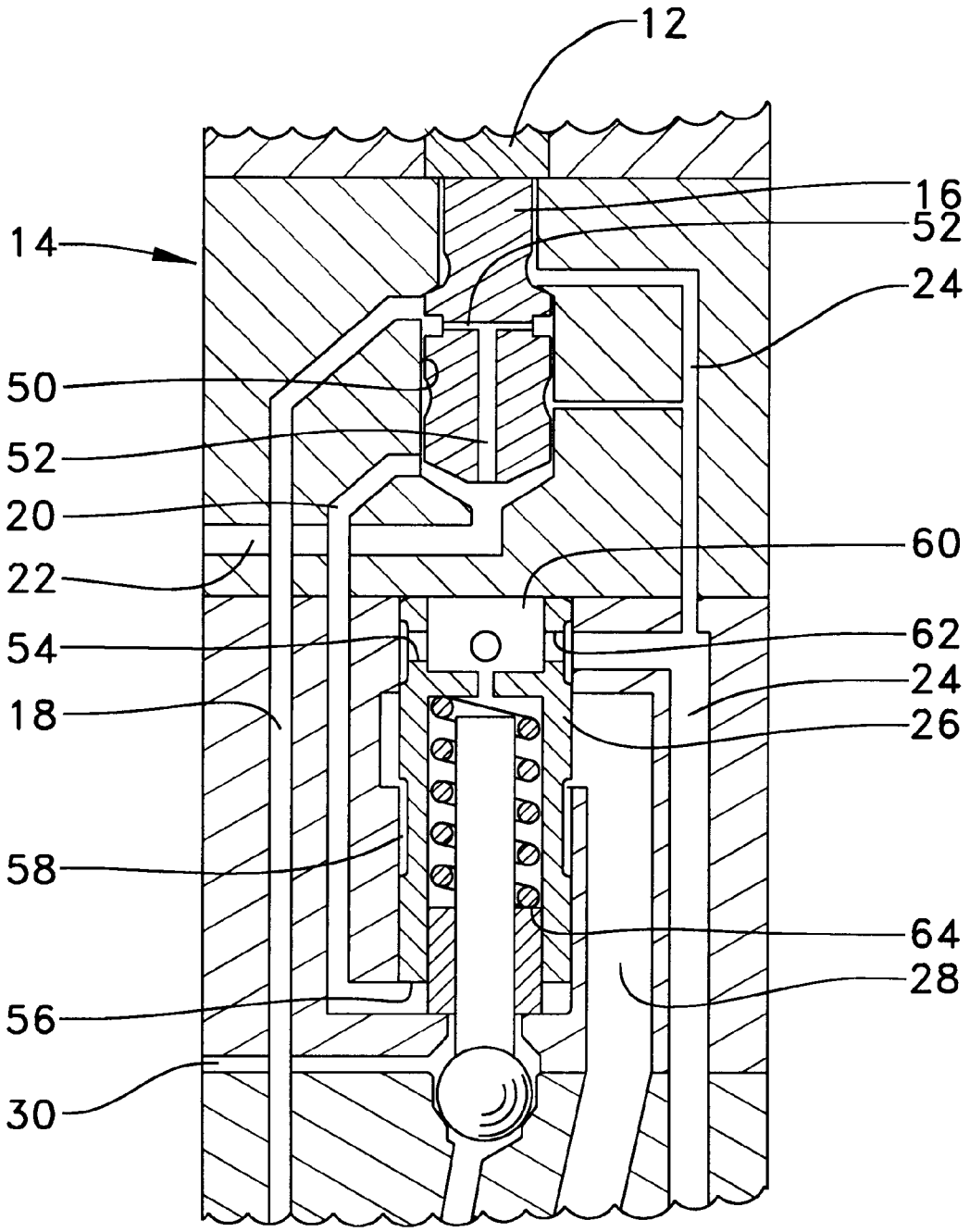
FIG. 2 is a diagrammatic side view representation of an upper portion of the fuel injector of FIG. 1 with an actuation valve member in a first position.

With reference to FIGS. 1 and 2, a first embodiment of a fuel injector 10 according to the invention has a motor 12 with two-wire control and includes an actuation valve 14 comprising an actuation valve member 16. The motor 12 can be a solid state expansion device composed of any electrically or magnetically expandable material, piezo or magnetostrictive for example.

The motor 12 can comprise or consist of material that expands when energized, as with a standard piezo stack for example, or may contract when energized, for example a thermally pre-stressed, bending unimorph piezo device comprising ferroelectric wafers such as those described in U.S. Pat. No. 5,632,841 assigned to the National Aeronautics and Space Administration (NASA).

The actuation valve member 16 is fluidly connected with a check control line 18, a pressure control line 20, an actuator drain 22, and a high-pressure line 24 connected to a source (not shown) of high-pressure hydraulic fluid, a common rail for example.

An inverse-action spool 26 fluidly connects with the pressure control line 20, the high-pressure line 24, an intensifier control line 28, and a spool drain 30. The intensifier control line 28 is fluidly connected with an intensifier piston 32 slidably disposed in the fuel injector. Beneath the intensifier piston a plunger 34 partially defines a fuel pressurization chamber 36. In other embodiments the plunger 34 may be integral with the intensifier piston 32.

The fuel pressurization chamber 36 is fluidly connected with a nozzle chamber 38 in a nozzle 40 having at least one nozzle orifice 42. A check 44 slidably extends into the nozzle chamber 38. A top portion of the check partially defines a check control chamber 46 fluidly connected with the check control line 18. A check spring 48 in the check control chamber 46 biases the check 44 downward.

FIG. 2 shows an upper portion of the fuel injector of the first embodiment in greater detail. The actuation valve 14 of this embodiment is a poppet valve 14 with an actuation valve member 16 disposed for linear movement in a bore 50. The actuation valve member 16 has an internal drain 52 that fluidly connects with the actuator drain 22.

The inverse-action spool 26 has an opening hydraulic surface 54, a closing hydraulic surface 56, a drain annulus 58 fluidly connected with the spool drain 30 (connection not shown), and defines a spool chamber 60 and a high-pressure annulus 62 fluidly connected with the high-pressure line 24. The inverse-action spool 26 is biased upward by a spool valve spring 64 for example.

Figure 3:
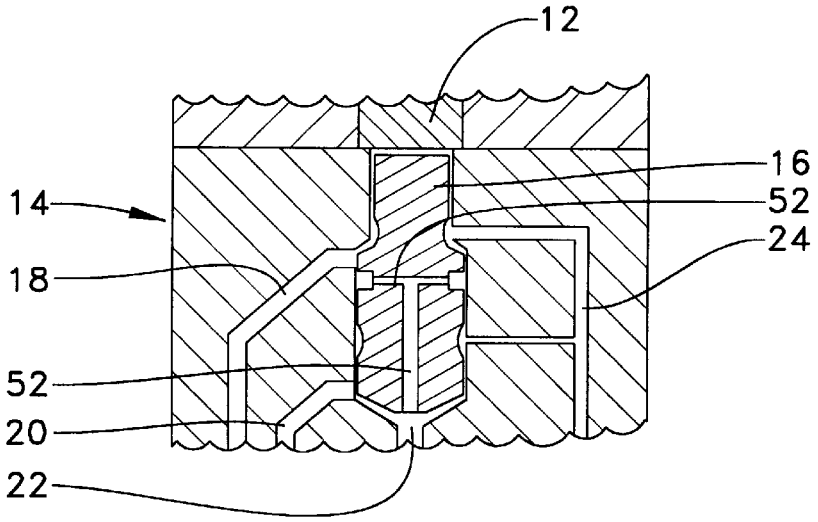
FIGS. 3 and 4 are diagrammatic side view representations of the actuation valve member of FIG. 2 in second and third positions, respectively.
Figure 4:
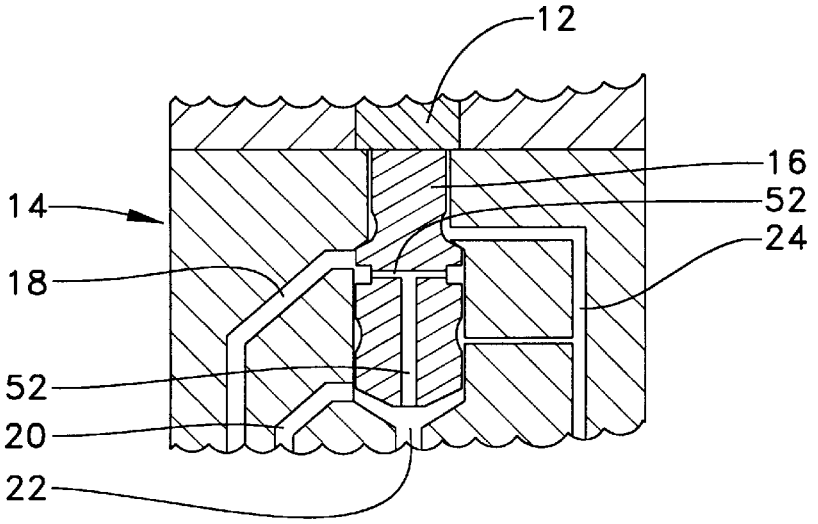

The actuation valve member 16 is shown in a first position in FIG. 2. Second and third positions for the actuation valve member 16 are shown in FIGS. 3 and 4, respectively.

Figure 5:
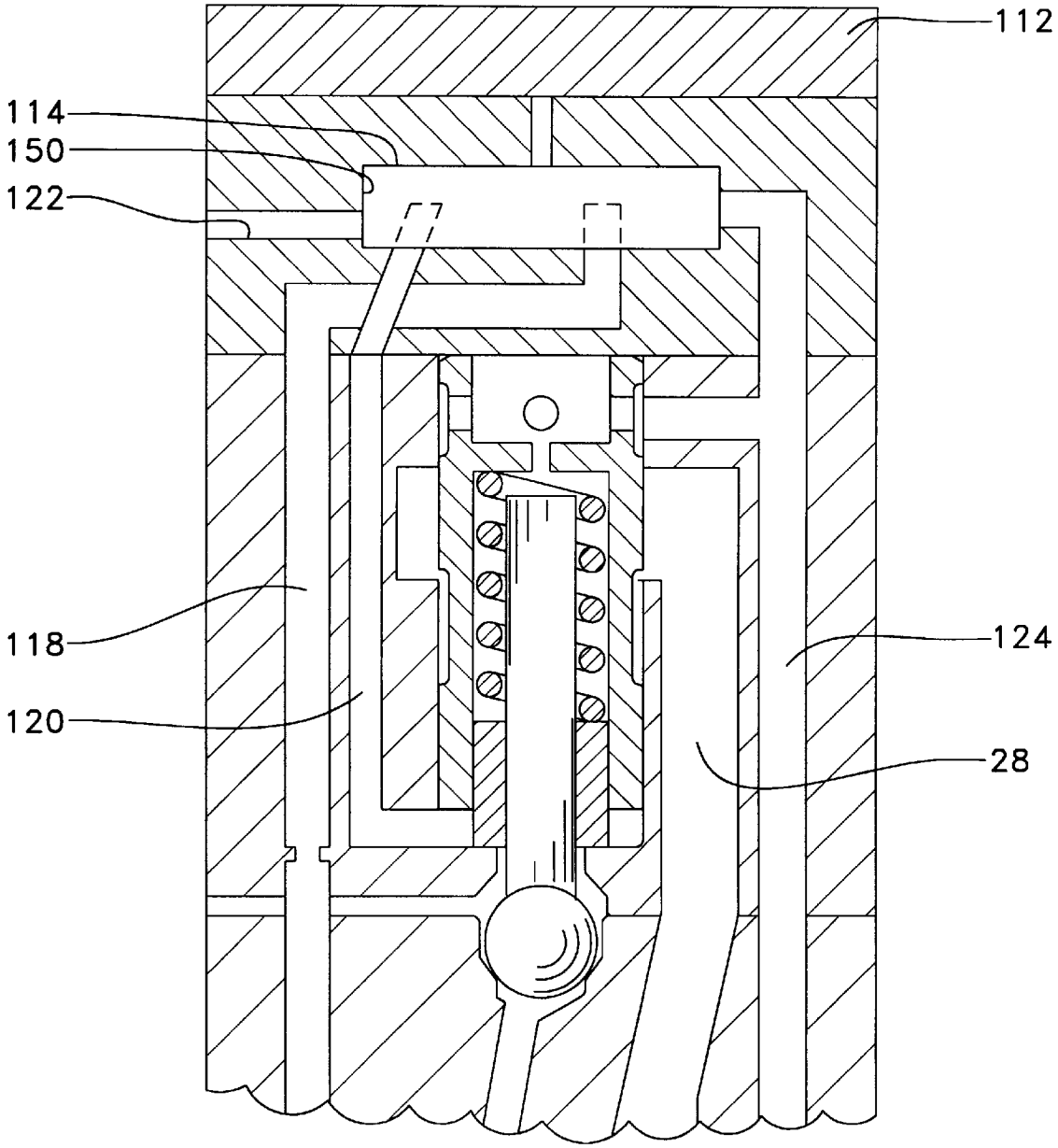
FIG. 5 is a diagrammatic side view representation of an upper portion of a fuel injector according to a second embodiment of the invention.

FIG. 5 shows an upper portion of a fuel injector according to a second embodiment of the invention. (Portions of all the illustrated embodiments not shown in their respective figures are the same as in FIG. 1.) An actuation valve 114 in the second embodiment is a rotary valve 114 utilizing a stepped motor 112 for example and includes a rotary actuation valve member 116 (FIGS. 6–8) rotatably disposed in a bore 150 and fluidly connected with a high-pressure line 124, a check control line 118, a pressure control line 120, and an actuator drain 122.

Figure 6:
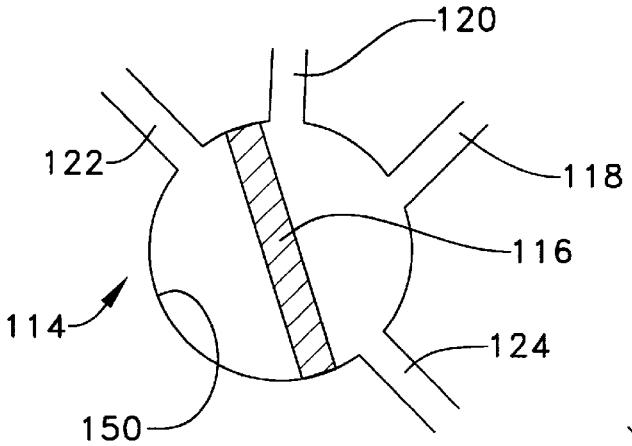
FIGS. 6–8 are diagrammatic top view representations of the actuation valve member of FIG. 5 in first, second, and third positions, respectively.
Figure 7:
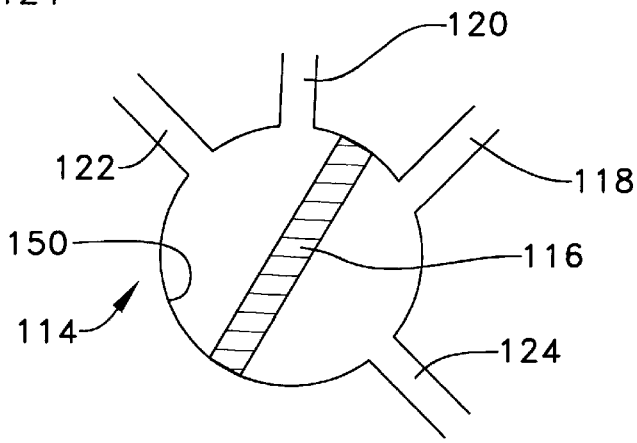
Figure 8:
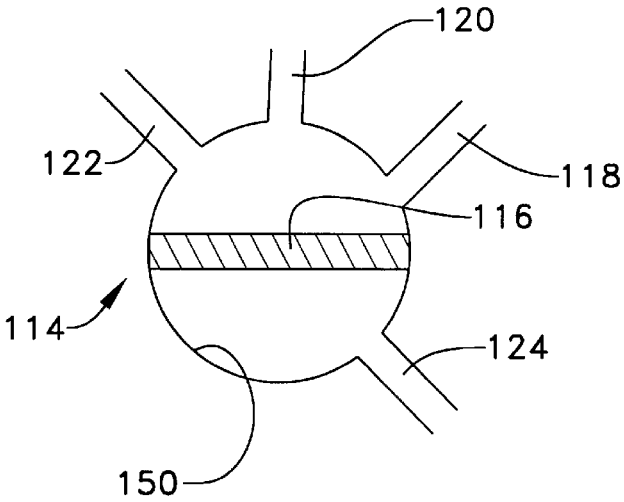
Figure 9:
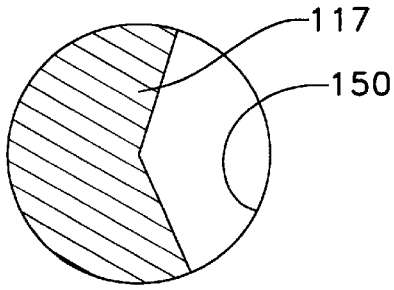
FIG. 9 is a diagrammatic top view representation of an alternate shape for the actuation valve member of FIG. 5.

FIGS. 6–8 show the actuation valve member 116 of the second embodiment in first, second, and third positions, respectively. FIG. 9 shows an alternate shape 117 for the actuation valve member 116 of the second embodiment.

Figure 10:
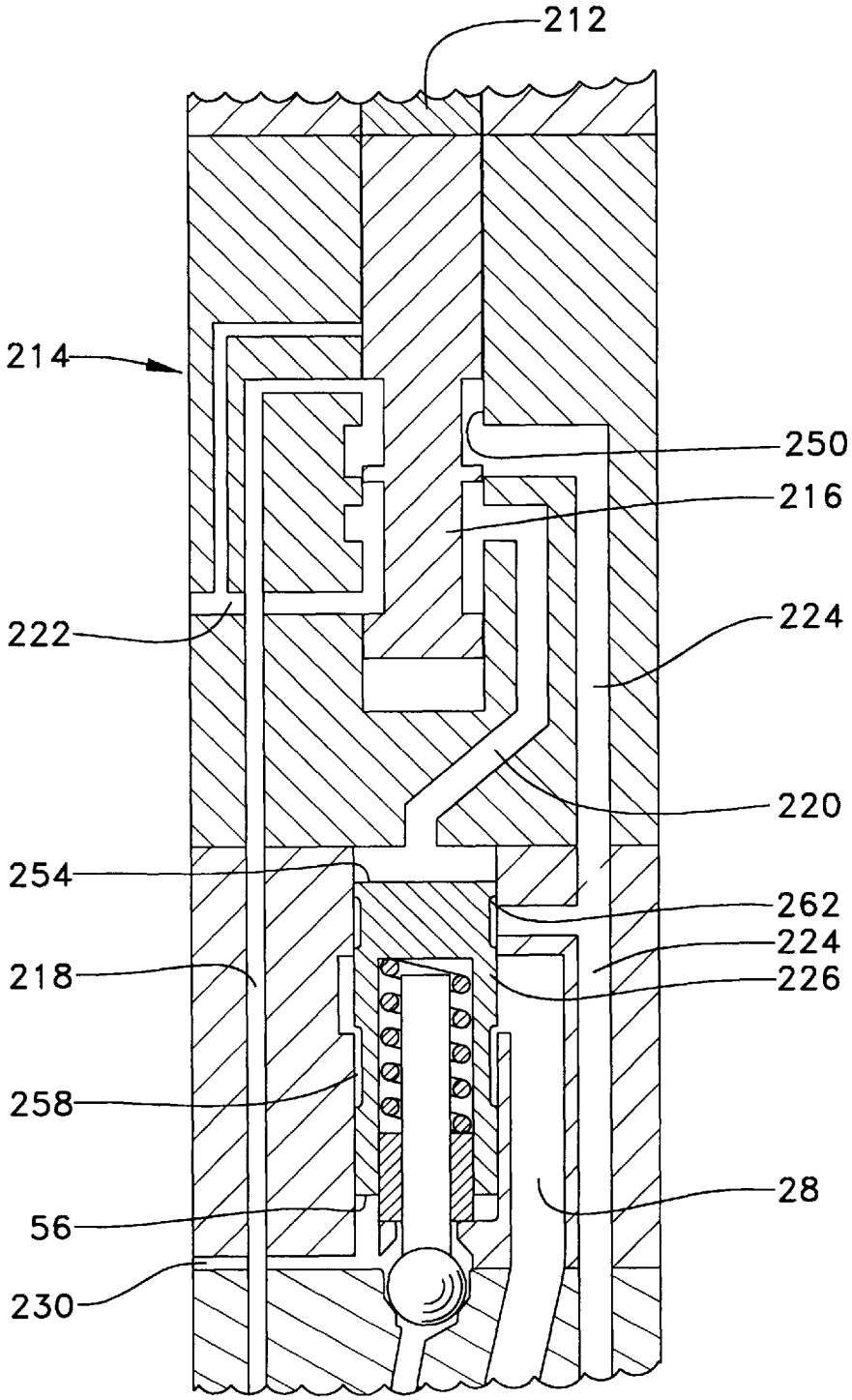
FIG. 10 is a diagrammatic side view representation of an upper portion of a fuel injector according to a third embodiment of the invention, with an actuation valve member in a first position.

FIG. 10 shows an upper portion of a fuel injector according to a third embodiment of the invention. This embodiment has a motor 212 similar to that of the first embodiment (FIG. 1). An actuation valve 214 in the third embodiment is a pilot valve 214 with an actuation valve member 216 slidably disposed in an bore 250. The actuation valve member 216 is fluidly connected with a high-pressure line 224, a check control line 218, a pressure control line 220, and an actuator drain 222.

In this embodiment a direct-action spool 226 fluidly connects with the pressure control line 220, the high-pressure line 224, the intensifier control line 28, and a spool drain 230. The direct-action spool 226 has an opening hydraulic surface 254 fluidly connected with the pressure control line 220 and a high-pressure annulus 262 fluidly connected with the high-pressure line 224.

Figure 11:
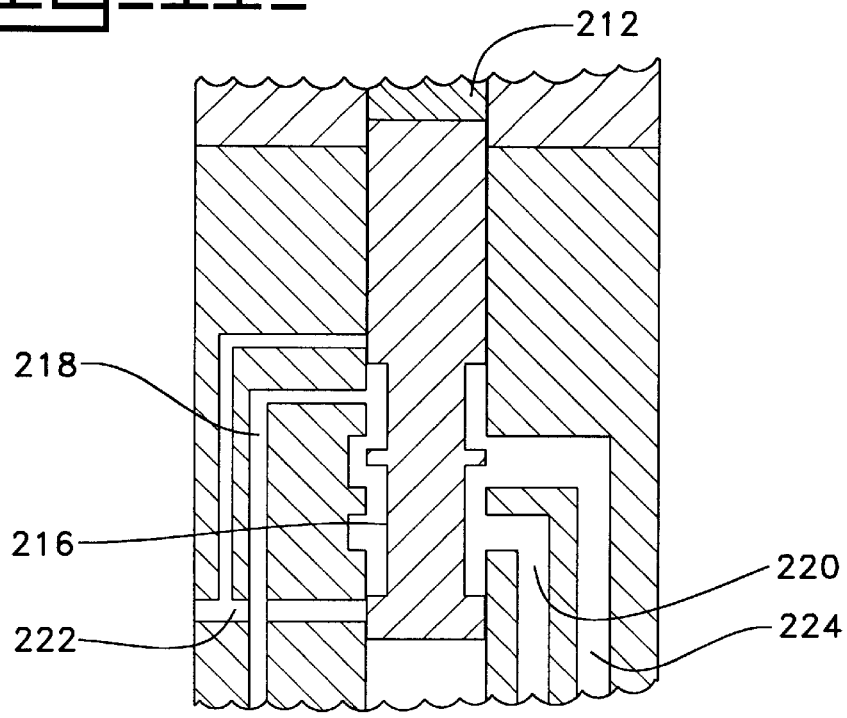
FIGS. 11 and 12 are diagrammatic side view representations of the actuation valve member of FIG. 10 in second and third positions, respectively.
Figure 12:
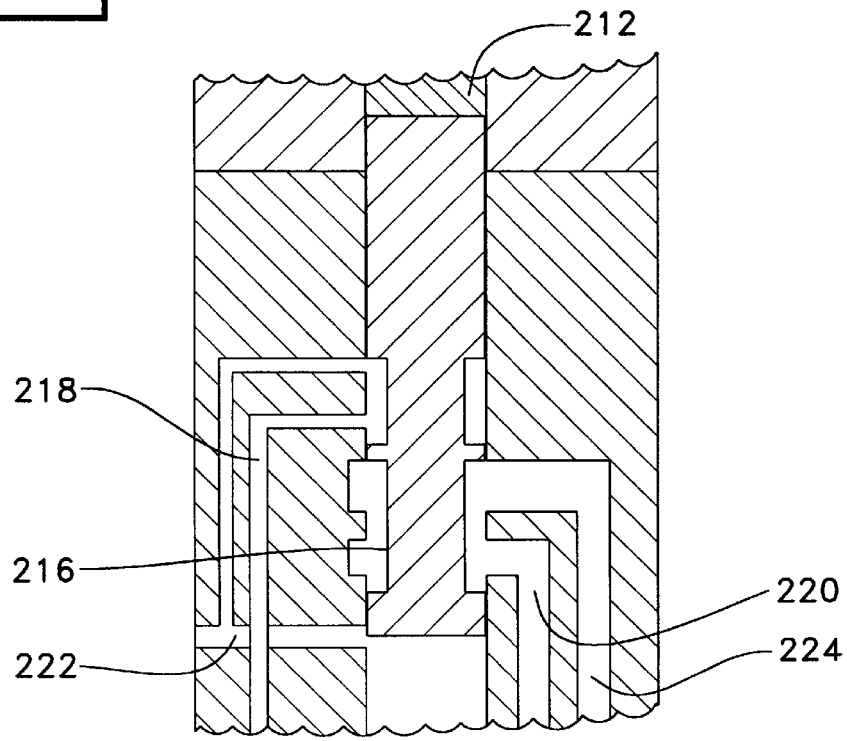

The actuation valve member 216 of this embodiment is illustrated in FIG. 10 in a first position. FIGS. 11 and 12 show the actuation valve member 216 in second and third positions, respectively.

Figure 13:
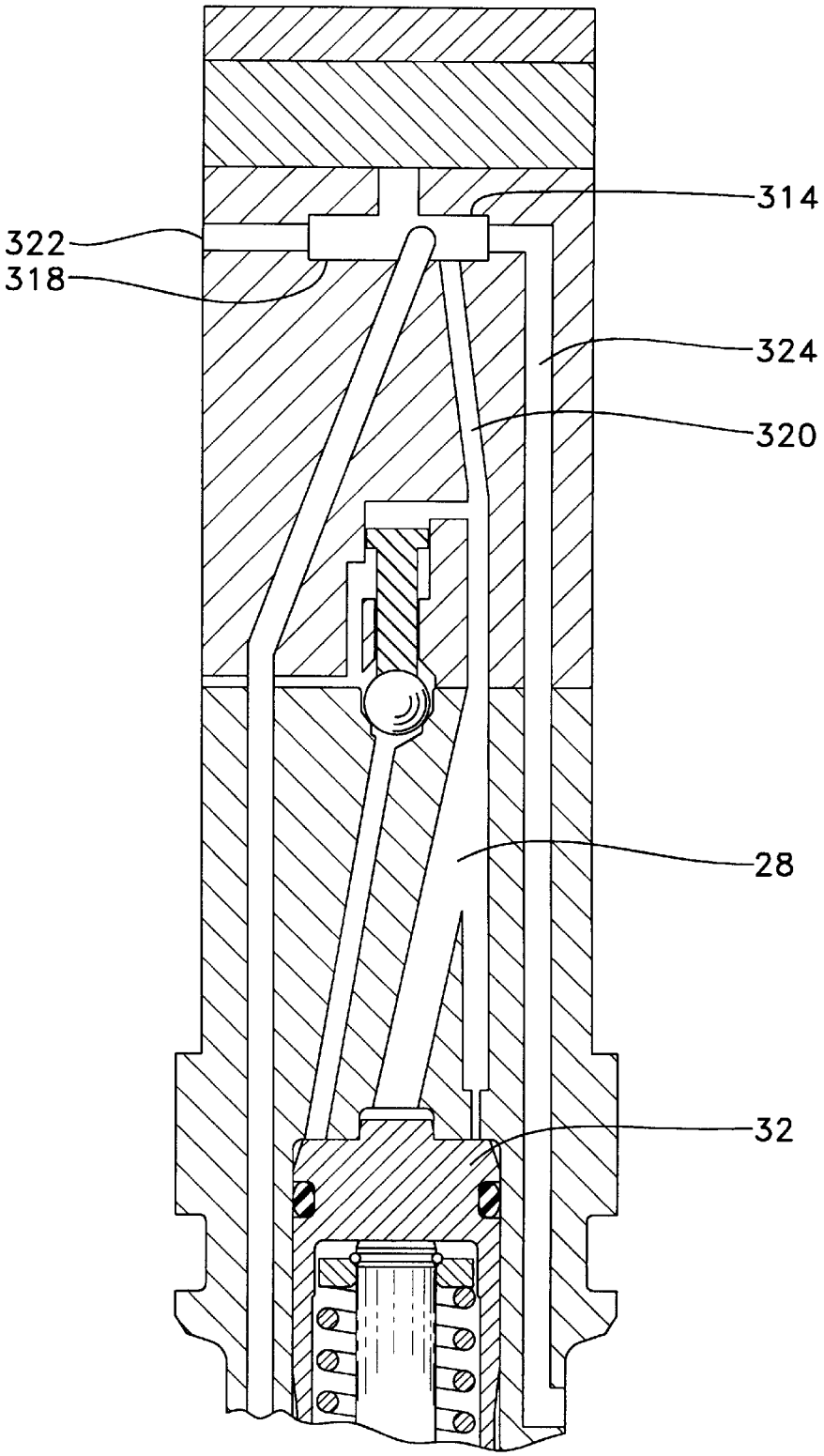
FIG. 13 is a diagrammatic side view representation of an upper portion of a fuel injector according to a fourth embodiment of the invention.
Figure 14:
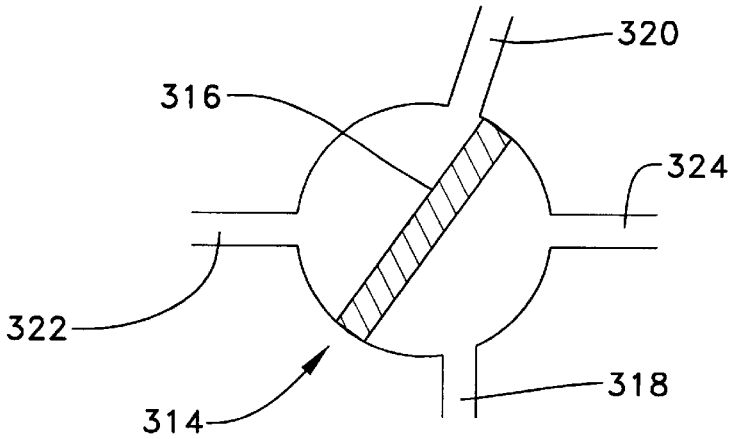
FIGS. 14–16 are diagrammatic top view representations of the actuation valve member of FIG. 13 in first, second, and third positions, respectively.
Figure 15:
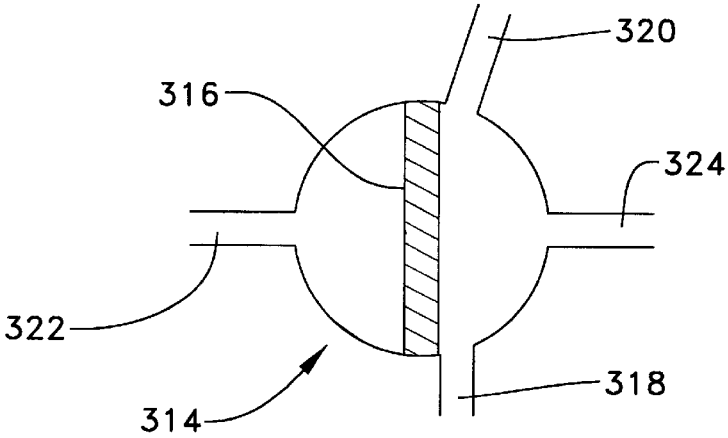
Figure 16:
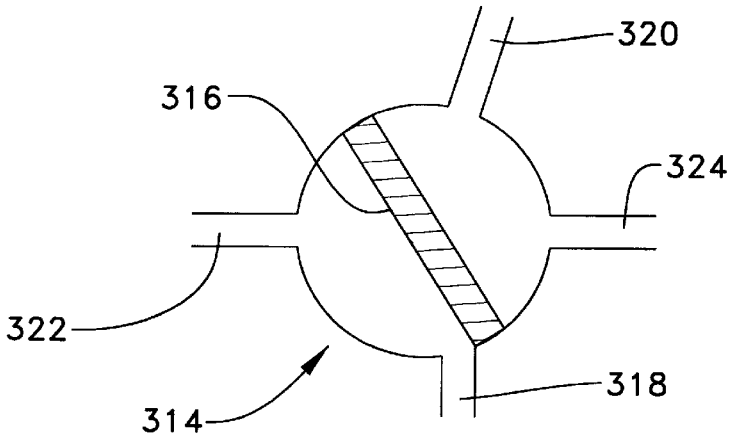

FIG. 13 shows an upper portion of a fuel injector according to a fourth embodiment of the invention. This embodiment has a rotary actuation valve 314, with an actuation valve member 316 (FIGS. 14–16) fluidly connected with a high-pressure line 324, a check control line 318, an actuator drain 322, and a pressure control line 320. In this embodiment the actuation valve 314 is fluidly connected directly with the intensifier piston 32 via the pressure control line 320, so that the pressure control line 320 essentially is, or is at least fluidly continuous with, the intensifier control line 28. FIGS. 14–16 show the actuation valve member 316 of FIG. 13 in first, second, and third positions, respectively.

Figure 17:
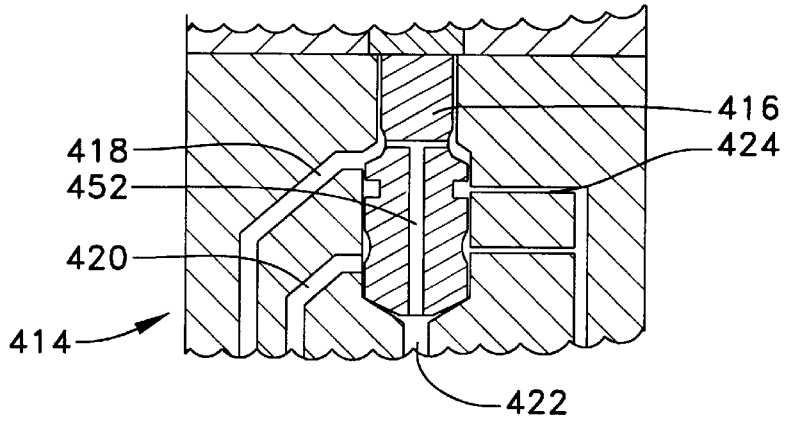
FIGS. 17–19 illustrate first, second, and third possible alternate actuation valve configurations for practicing the invention.
Figure 18:
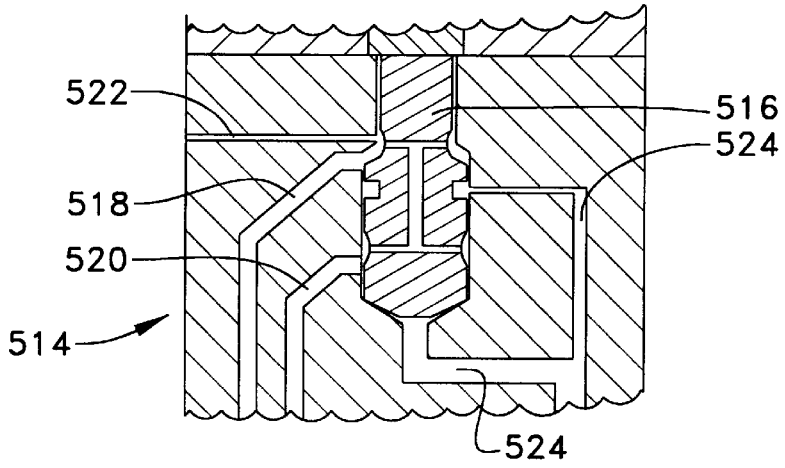
Figure 19:
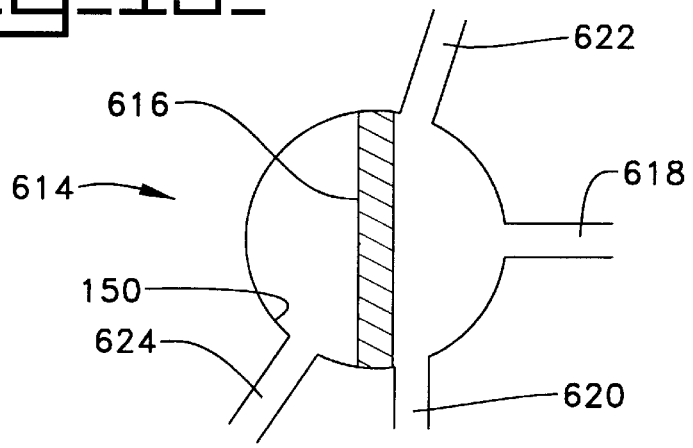

FIGS. 17–19 show other possible actuation valves 414, 514, 614 for practicing the invention. An actuation valve member 416 shown in FIG. 17 has an internal drain 452 and is connected with a check control line 418, a pressure control line 420, an actuator drain 422, an internal drain 452, and high-pressure lines 424.

An actuation valve member 516 shown in FIG. 18 has an internal drain 552 and is connected with a check control line 518, a pressure control line 520, an actuator drain 522, an internal drain 552, and high-pressure lines 524.

An actuation valve member 616 shown in FIG. 19 is connected with a check control line 618, a pressure control line 620, an actuator drain 622, and a high-pressure line 624.

Industrial Applicability

The illustrated embodiments allow an engine to control a fuel injector using as few as two wires to regulate movement of an actuation valve member among at least three positions. In the linear valve configurations the motor changes position of the actuation valve member by varying current applied to the motor, so only two control wires are required. Toggling between two of these positions allows split injections, pre-metering, post-injections, micrometering of fuel into the combustion chamber, etc. by operating a positive hydraulic bias (i.e., a pushing rather than a pulling hydraulic bias) against the check 44 while pressure is kept high in the nozzle chamber 38 for as long as necessary. A third position releases pressure in the nozzle chamber 38, allowing the fuel injector to refuel.

For example, the first embodiment shown in FIGS. 1–4 works as follows. When the motor 12 positions the actuation valve member 16 at the first position illustrated in FIGS. 1 and 2, both the check control line 18 and the pressure control line 20 are connected with the high-pressure line 24. The high pressure hydraulic fluid in the check control line 18 flows down into the check control chamber 46 and biases the check 44 toward a closed position, a position that closes fluid communication between the nozzle chamber 38 and the nozzle orifice 42.

Meanwhile, the high-pressure hydraulic fluid in the pressure control line 20 is supplied to the inverse-action spool 26. The term "inverse-action spool" is used herein to indicate that in contrast to some other embodiments, as explained below high pressure in the pressure control line 20 connected with the spool causes fuel pressure reduction in the nozzle chamber 38, while low pressure in the pressure control line 20 causes fuel pressure in the nozzle chamber 38 to increase.

When the actuation valve member 16 is at the first position, high pressure at the closing hydraulic surface 56 of the inverse-action spool 26 balances the hydraulic bias at the opening hydraulic surface 54 caused by high-pressure hydraulic fluid in the spool chamber 60 that is always in fluid communication with the high-pressure line 24. This allows the spool valve spring 64 to keep the spool in the up (closed) position, closing off the intensifier control line 28 from the high-pressure line 24, while opening the intensifier control line 28 to the spool drain 30 via the drain annulus 58. This allows the intensifier piston 32 and the plunger 34 to withdraw so the fuel pressurization chamber 36 can be refilled. (The connection between the spool drain 30 and the drain annulus 58 is not visible in this cross-section.)

When the motor 12 positions the actuation valve member 16 at the second position, illustrated in FIG. 3, the pressure control line 20 is closed off from the high-pressure line 24 and opened to the actuator drain 22. This reduces fluid pressure against the closing hydraulic surface 56. Then the force of the high-pressure hydraulic fluid on the opening hydraulic surface 54 overcomes the force of the spool valve spring 64 and pushes the spool downward. This closes off the intensifier control line 28 from the drain annulus 58, while opening the intensifier control line 28 to the high-pressure line 24 via the high-pressure annulus 62.

Accordingly, high-pressure hydraulic fluid in the intensifier control line 28 pushes down on the intensifier piston 32 and plunger 34, which pressurizes fuel in the fuel pressurization chamber 36 and hence the nozzle chamber 38 until fuel pressure in the nozzle chamber 38 is high enough to overcome the bias of the check spring 48.

However, the check 44 still does not open because the check control line 18 is still connected with the high-pressure line 24, so that high pressure hydraulic fluid is still pushing against the check 44. Even the very high fluid pressure of the pressurized fuel in the nozzle chamber 38 cannot overcome the combined force of the check spring 48 the high-pressure hydraulic fluid providing closing bias against the check 44.

When the motor 12 positions the actuation valve member 16 at the third position, illustrated in FIG. 4, the pressure control line 20 is still connected to the drain, keeping fuel pressure in the nozzle chamber 38 high, but the check control line 18 is now cut off from the high-pressure line 24, and exposed to the actuator drain 22 via the internal drain 52. This relieves the hydraulic bias in the check control chamber 46 keeping the check 44 closed. Now the pressure of the highly pressurized fuel in the nozzle chamber 38 can overcome the force of the check spring 48, and the check 44 opens and fuel injection commences.

It can be appreciated that waiting until the fuel in the nozzle chamber 38 is fully pressurized and then opening the check 44 by quickly relieving the pressure in the check control chamber 46 via the check control line 18 allows initiation of fuel injection to occur much more quickly and under better timing control than can be achieved by relying on the (comparatively slow) action of the intensifier piston 32 alone to cause initiation of fuel injection by pressurizing the fuel in the nozzle chamber 38. Thus "ramping" is greatly reduced, allowing sharp "square wave" fuel injection initiation.

After the injection "shot" is completed, a very quick cessation of fuel injection can be achieved by returning the actuation valve member 16 to the second position. The check control line 18 is once again filled with high pressure hydraulic fluid, which quickly shuts the check 44, even while the fuel in the nozzle chamber 38 remains fully pressurized. It can be appreciated that many successive "shots" can be performed in rapid succession at this point, by toggling the actuation valve member 16 between the second and third positions.

Unlike previous fuel injectors, this can be done for as long as needed because while the actuation valve member 16 is kept at the second and third positions fully pressurized fuel remains in the nozzle chamber 38 as long as there is still fuel left in the fuel pressurization chamber 36. Full fuel pressure can be kept indefinitely, for a controllable length of time, by controlling the length of time until the actuation valve member 16 is returned to the first position.

Finally, the motor 12 positions the actuation valve member 16 back at the first position, in which the pressure control line 20 is closed off from the actuator drain 22 and is exposed to high pressure hydraulic fluid from the high-pressure line 24. Once again, the high pressure hydraulic fluid in the pressure control line 20 acts against the closing hydraulic surface 56 to balance the hydraulic fluid pressure against the opening hydraulic surface 54, allowing the spool valve spring 64 to move the spool upward. This closes off the intensifier control line 28 from the high-pressure annulus 62, while opening the intensifier control line 28 to the drain annulus 58. When the pressure against the intensifier piston 32 is thus relieved, low-pressure fuel from the fuel inlet can push the intensifier piston 32 upward, allowing more fuel to enter the fuel pressurization chamber 36 in preparation for the next injection cycle.

The actuation valve member is maintainable at each of the three positions for a controllable period of time. The phrase "positioned at" a given position, as used herein when discussing movement of actuation valve members, means moved to and stopped (or made to hover) at the recited position (or close enough to achieve the intended function), as opposed to merely passing through in uncontrolled movement on its way to another position. However, in some embodiments an actuation valve member could be "positioned at" a position by moving it through a position or a position range in a controlled manner so that it achieves the required function of the position for a controllable length of time.

The second embodiment illustrated in FIGS. 5–8 operates in the same way as the first embodiment of FIGS. 1–4, except that the rotary valve 114 with the actuation valve member 116 is used. FIG. 6 shows the actuation valve member 116 in its first position which connects the high-pressure line 124 with both the pressure control line 120 and the check control line 118, for reducing fuel pressure and adding fuel to the fuel pressurization chamber 36.

To raise fuel pressure in the fuel pressurization chamber 36 and hence the nozzle chamber 38, the actuation valve member 116 is rotated to position it at its second position shown in FIG. 7. The pressure control line 120 drains via the actuator drain 122, causing the spool 26 to direct high-pressure hydraulic fluid to push against the intensifier piston 32, raising fuel pressure as described above. The check control line 118 continues to supply high-pressure hydraulic fluid to bias the check 44 in its closed position.

To commence fuel injection, the actuation valve member 116 is rotated to position it at its third position shown in FIG. 8. The pressure control line 120 continues to drain, keeping fuel pressure high. The check control line 118 now also drains via the actuator drain 122, relieving the hydraulic bias against the check 44 and allowing it to open and fuel injection to occur. As in the first embodiment, the actuation valve member 116 may be rotatably toggled between the second and third positions to turn fuel injection off and on repeatedly while keeping injection pressure constant.

Alternatively, where differing ramp profiles are desired, the actuation valve member 116 may be rotatably toggled between the first and third positions to turn fuel injection off and on while varying injection pressure. Additionally, because this is a rotary valve, the actuation valve member can be moved between the first and third positions without passing through the second position.

It can be appreciated that with this design the high-pressure actuation fluid entering from the high-pressure line 124 will not bias the actuation valve member 116 either toward one position or the other, so that performance of the rotary actuation valve 114 should be independent of variations in the high-pressure hydraulic fluid rail or other source of high-pressure hydraulic fluid.

The actuation valve member 116 of FIGS. 6–8 is made narrow to have small mass, but for stability, ease of manufacture, or hydraulic flow considerations for example, the rotary actuation valve member 116 may be given any number of different shapes, for example the actuation valve member 117 shown in FIG. 9.

In the third embodiment illustrated in FIGS. 10–12 the actuation valve 214 reverses pressure status of the pressure control line 220 to operate the direct-action spool 226 valve. The term "direct-action spool" is used herein to indicate that, in contrast to the inverse-action spool explained above, low pressure in the pressure control line 20 connected with the spool causes fuel pressure reduction in the nozzle chamber 38, while high pressure in the pressure control line 20 causes fuel pressure in the nozzle chamber 38 to increase.

In its first position shown in FIG. 10, the actuation valve member 216 connects the check control line 218 with the high-pressure line 224, and connects the pressure control line 220 with the actuator drain 222. Since the opening hydraulic surface 254 of the direct-action spool 226 valve is exposed to low-pressure, closing bias provided by the spool spring keeps the direct-action spool 226 valve pushed up so that the intensifier control line 28 is connected with the drain annulus 258.

Sliding the actuation valve member 216 upward to position it at the second position shown in FIG. 11 keeps high pressure in the check control line 218, but disconnects the pressure control line 220 from the actuator drain 222 and connects it with the high-pressure line 224. High pressure in the pressure control line 220 presses down on the opening hydraulic surface 254 of the direct-action spool 226, overcoming the closing bias of the spool spring to push the spool 226 down. This connects the intensifier control line 28 to the high-pressure line 224 via the high-pressure annulus 262, which pressurizes fuel in the nozzle chamber 38 as explained above.

Finally, sliding the actuation valve member 216 up to position it at the third position shown in FIG. 12 drains the check control line 218 while keeping high-pressure in the pressure control line 220, allowing repeatable fuel injection events and constant injection pressure as explained above.

In embodiments such as the fourth embodiment shown in FIGS. 13–16, the pressure control line 320 acts as the intensifier control line 28, eliminating the need for a spool controlled by the actuator valve to fluidly connect the high-pressure hydraulic fluid with the high-pressure line 324 to the intensifier control line 28. Instead, the pressure control line 320 feeds high-pressure hydraulic fluid directly to the intensifier piston 32.

In its first position shown in FIG. 14, the actuation valve member 316 connects the check control line 318 with the high-pressure line 324 but connects the pressure control line 320 with the actuator drain 322, allowing fuel refilling.

In its second position shown in FIG. 15, the actuation valve member 316 keeps the check control line 318 connected with the high-pressure line 324, keeping closing hydraulic pressure on the check 44, while also connecting the pressure control line 320 with the high-pressure line 324, allowing high pressure hydraulic fluid to push against the intensifier piston 32, which in turn pressurizes fuel in the fuel pressurization chamber 36.

In its third position shown in FIG. 16, the actuation valve member 316 connects the check control line 318 with the actuator drain 322, removing the closing hydraulic bias on the check 44 to allow fuel injection, while continuing to supply high-pressure hydraulic fluid from the high-pressure line 324 to the intensifier piston 32 via the pressure control line 320, keeping fuel pressure constant in the nozzle chamber 38.

By eliminating the need for a spool valve the fuel injector becomes less complex, less costly, and has fewer moving parts that can wear out and cause the fuel injector to fail. Also, the delay of waiting for the spool valve to move is eliminated, so that timing variation that might occur shot-to-shot or over the lifetime of the fuel injector is reduced.

Various combinations of the illustrated actuation valve and spool/no spool configurations are possible. For instance, the rotary valve 314 of FIGS. 13–16 could be used to control the direct-action spool 226 of FIG. 10 according to the invention. Similarly, the actuation valve 214 of FIGS. 10–12 could be used to control a no-spool design similar to that of FIG. 13, for direct actuation valve control of the intensifier piston 32.

Additionally the valve "plumbing" could be rearranged in both linear and rotary actuation valves to alternate the sequence of valve positions, while still practicing the claimed invention. For example, embodiments could be manufactured that would operate between a first position for refilling a fuel injector, a second position for injecting fuel, and a third position for using hydraulic biasing to keep the check closed while keeping fuel pressure high. With such a configuration single and/or split injections can be performed with little or no ramping by toggling between the second and third positions, while single and/or split injections with ramping (when desired) can be performed by toggling between the first and second positions.

Another variation could be to eliminate hydraulic biasing to keep the check closed during the "refill" position, as opposed to previously described embodiments which keep the check closed with hydraulic bias at the first position.

These alternative embodiments could be constructed in any number of ways. For example, in the first position the linear actuation valve member 416 of a first alternate actuation valve 414 configuration of FIG. 17 would connect the check control line 418 with the actuator drain 422 via the internal drain 452 and would connect the high-pressure line 424 with the pressure control line 420 leading to the inverse-action spool 226 (FIG. 2). In the second position the actuation valve member 416 would connect both the check control line 418 and the pressure control line 420 with the actuator drain 422, causing the inverse-action spool 226 valve to connect the high-pressure line 424 with the intensifier control line 28. In the third position the actuation valve member 416 would keep the pressure control line 420 connected with the actuator drain 422, but would connect the check control line 418 with the high-pressure line 424, causing closing bias on the check 44.

In another example, in the first position the linear actuation valve member 516 of a second alternate actuation valve 514 configuration of FIG. 18 would connect both the check control line 518 and the pressure control line 520 with the actuator drain 522, and would connect the pressure control line 520 either with the direct-action spool 226 (FIG. 10) or directly with the intensifier piston 32 (FIG. 13). In the second position the check control line 518 would remain connected with the actuator drain 522, but the pressure control line 520 would be connected with the high-pressure line 524, causing fuel injection to start. In the third position both the check control line 518 and the pressure control line 520 would be connected with the high-pressure line 524, causing closing bias on the check 44 to stop fuel injection.

In yet another example, in the first position the rotary actuation valve member 616 of a third alternate actuation valve 614 configuration, as shown in FIG. 19, would connect both the check control line 618 and the pressure control line 620 with the actuator drain 622, and would connect the pressure control line 620 either with the direct-action spool 226 (FIG. 10) or directly with the intensifier piston 32 (FIG. 13). With the actuation valve member 616 rotating counter-clockwise to the second position, the check control line 618 would remain connected to the actuator drain 622, but the pressure control line 620 would be connected with the high-pressure line 624, causing fuel injection to start. With the actuation valve member 616 rotating further counter-clockwise to the third position, both the check control line 618 and the pressure control line 620 would be connected with the high-pressure line 624, causing closing bias on the check 44 to stop fuel injection.

Many additional combinations of the different disclosed elements of the invention are possible. Accordingly, while the invention has been illustrated and described in detail in the drawings and foregoing description, such illustration and description are to be considered illustrative or exemplary and not restrictive; the invention is not limited to the disclosed embodiments. Also, positions are numbered in the claims for distinguishing positions recited within that claim; the positions may not be numbered in any particular claim in the same order as in a disclosed embodiment's description.

Other types of variations can also easily be made in practicing the invention. For example, the fuel injector in the illustrated embodiments utilizes a check spring 48 to provide closing bias on the check 44. Other embodiments for practicing the invention may use a different type of mechanical bias, or may rely entirely on hydraulic bias, from the check control chamber 46 and the nozzle chamber 38 for example, to bias the check 44.

Additionally, illustrated rotary valve embodiments use a stepped motor, but a linear motor or piezo stack with linear-to-rotational motion translation, or any other method of rotating the actuation valve members may be used. As another example, in the illustrated rotary embodiments the various fluid lines are shown entering the rotary valve bores from the side. In other embodiments fluid lines may enter from the top and/or bottom instead, or as well.

Further, the function of the poppet-type linear actuation valve 14 of FIGS. 2–4 could be accomplished using a pilot or spool actuation valve, just as the function of the spool-type linear actuation valve 214 of FIGS. 10–12 could be accomplished using a poppet-type actuation valve.

Countless other variations to the disclosed embodiments can also be made by those skilled in the art while practicing the claimed invention from a study of the drawings, the disclosure, and the appended claims.

What is claimed is:

1. A hydraulically actuated fuel injector comprising:

a nozzle having a nozzle orifice and a nozzle chamber;

a check movable between an open position that allows fluid communication between the nozzle chamber and the nozzle orifice, and a closed position that stops fluid communication between the nozzle chamber and the nozzle orifice;

a check control chamber disposed such that fluid pressure in the check control chamber will exert a closing bias on the check;

an actuation valve member fluidly connected with a high-pressure supply line, a low-pressure drain line, a check control line fluidly connected with the check control chamber, and a pressure control line, the actuation valve member being positionable at:

a first position that fluidly connects the pressure control line to a first line of the high-pressure supply line and the low-pressure drain line;

a second position different from the first position that fluidly connects the check control line to the high-pressure supply line and fluidly connects the pressure control line to a second line of the high-pressure supply line and the low-pressure drain line, the second line being different from the first line; and third position, different from the first and second positions, that fluidly connects the check control line with the low-pressure drain line and fluidly connects the pressure control line to the second line.

2. The hydraulically actuated fuel injector of claim 1, wherein said first position further fluidly connects the check control line with the high-pressure supply line.

3. The hydraulically actuated fuel injector of claim 1, wherein said first line is the high-pressure supply line and said second line is the low-pressure drain line.

4. The hydraulically actuated fuel injector of claim 1, wherein said first line is the low-pressure drain line and said second line is the high-pressure supply line.

5. The hydraulically actuated fuel injector of claim 4, wherein the pressure control line is fluidly connected with an opening hydraulic surface of a spool, and the spool is moveable by a hydraulic bias against the opening hydraulic surface to connect the high-pressure supply line with an intensifier piston.

6. The hydraulically actuated fuel injector of claim 4, wherein the pressure control line is fluidly connected with an intensifier piston.

7. The hydraulically actuated fuel injector of claim 1, the actuation valve member being slidable between the first, second, and third positions.

8. The hydraulically actuated fuel injector of claim 1, the actuation valve member being rotatable between the first, second, and third positions.

9. The hydraulically actuated fuel injector of claim 1, further comprising a thermally pre-stressed, bending unimorph piezo device comprising ferroelectric wafers connected with the actuation valve member.

10. The hydraulically actuated fuel injector of claim 1, further comprising a magnetostrictive device connected with the actuation valve member.

11. A method for controlling a hydraulically actuated fuel injector having a check, an intensifier piston, a nozzle chamber, and an electronically controlled actuator attached with an actuation valve member positionable at at least first, second, and third mutually distinct positions, comprising:

draining high-pressure hydraulic fluid biasing the intensifier piston, thereby reducing fuel pressure in the nozzle chamber and allowing fuel to enter the fuel injector, by positioning the actuation valve member at the first position;

causing high-pressure hydraulic fluid to provide hydraulic bias against the intensifier piston, thereby pressurizing fuel in the nozzle chamber to an injection pressure, while causing high-pressure hydraulic fluid to provide a closing bias on the check to prevent fuel injection, by positioning the actuation valve member at the second position;

causing fuel injection by draining the high-pressure hydraulic fluid providing the closing bias on the check, while continuing to cause high-pressure hydraulic fluid to provide hydraulic bias against the intensifier piston to keep fuel in the nozzle chamber at the injection pressure, by positioning the actuation valve member at the third position; and positioning the actuation valve member comprises rotating the actuation valve member.

12. A method for controlling a hydraulically actuated fuel injector having a check, an intensifier piston, a nozzle chamber, and an electronically controlled actuator attached with an actuation valve member positionable at at least first, second, and third mutually distinct positions, comprising:

draining high-pressure hydraulic fluid biasing the intensifier piston, thereby reducing fuel pressure in the nozzle chamber and allowing fuel to enter the fuel injector, by positioning the actuation valve member at the first position;

causing high-pressure hydraulic fluid to provide hydraulic bias against the intensifier piston, thereby pressurizing fuel in the nozzle chamber to an injection pressure, while causing high-pressure hydraulic fluid to provide a closing bias on the check to prevent fuel injection, by positioning the actuation valve member at the second position;

causing fuel injection by draining the high-pressure hydraulic fluid providing the closing bias on the check, while continuing to cause high-pressure hydraulic fluid to provide hydraulic bias against the intensifier piston to keep fuel in the nozzle chamber at the injection pressure, by positioning the actuation valve member at the third position; and the electronically controlled actuator comprises a thermally pre-stressed, bending unimorph piezo device comprising ferroelectric wafers.

13. A method for controlling a hydraulically actuated fuel injector having a check, an intensifier piston, a nozzle chamber, and an electronically controlled actuator attached with an actuation valve member positionable at at least first, second, and third mutually distinct positions, comprising:

draining high-pressure hydraulic fluid biasing the intensifier piston, thereby reducing fuel pressure in the nozzle chamber and allowing fuel to enter the fuel injector, by positioning the actuation valve member at the first position;

causing high-pressure hydraulic fluid to provide hydraulic bias against the intensifier piston, thereby pressurizing fuel in the nozzle chamber to an injection pressure, while causing high-pressure hydraulic fluid to provide a closing bias on the check to prevent fuel injection, by positioning the actuation valve member at the second position;

causing fuel injection by draining the high-pressure hydraulic fluid providing the closing bias on the check, while continuing to cause high-pressure hydraulic fluid to provide hydraulic bias against the intensifier piston to keep fuel in the nozzle chamber at the injection pressure, by positioning the actuation valve member at the third position; and the electronically controlled actuator comprises a magnetostrictive device.

* * * * *